US006324701B1

(12) United States Patent
Alexander

(10) Patent No.: US 6,324,701 B1
(45) Date of Patent: Dec. 4, 2001

(54) CHIN STRAP SYSTEM

(76) Inventor: Cherie F. Alexander, 7801 Wise La., Knoxville, TN (US) 37920

( * ) Notice: Subject to any disclaimer, the term of this patent is extended or adjusted under 35 U.S.C. 154(b) by 0 days.

(21) Appl. No.: 09/654,284

(22) Filed: Sep. 1, 2000

(51) Int. Cl.[7] ..... A42B 7/00
(52) U.S. Cl. ..... 2/421
(58) Field of Search ..... 2/421, 9

(56) References Cited

U.S. PATENT DOCUMENTS 3,187,342 * 6/1965 Aileo .
3,619,813 * 11/1971 Marchello .
4,646,368 3/1987 Infusino et al. .
4,692,947 9/1987 Black et al. .
5,347,660 9/1994 Zide et al. .
5,685,020 * 11/1997 Powell et al. ..... 2/421
5,794,274 8/1998 Kraemer .
6,081,932 * 7/2000 Kraemer ..... 2/421

FOREIGN PATENT DOCUMENTS 1 354 719 5/1974 (GB) .

* cited by examiner

*Primary Examiner*—Rodney M. Lindsey
(74) *Attorney, Agent, or Firm*—King and Schickli, PLLC

(57) ABSTRACT

A chin strap system a pair of elongate straps and a substantially rigid cup anatomically configured for receiving a chin of a user. Four apertures extend between an inner and outer surface of the cup for receiving the straps. The straps are adjustably positionable through the apertures so that the straps crisscross one another adjacent the outer surface of the cup between the apertures. Each strap has a pair of free ends extending in opposite directions from the cup and include fasteners operatively for fastening the straps to a helmet with which the strap is to be used.

4 Claims, 4 Drawing Sheets

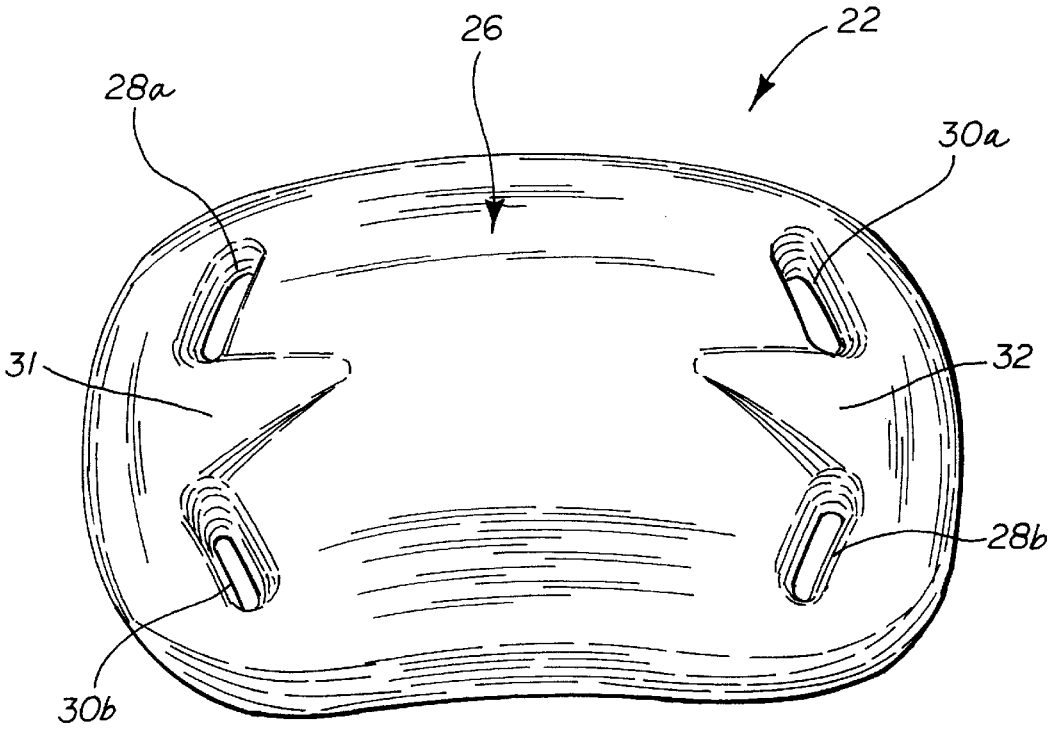
Fig. 4
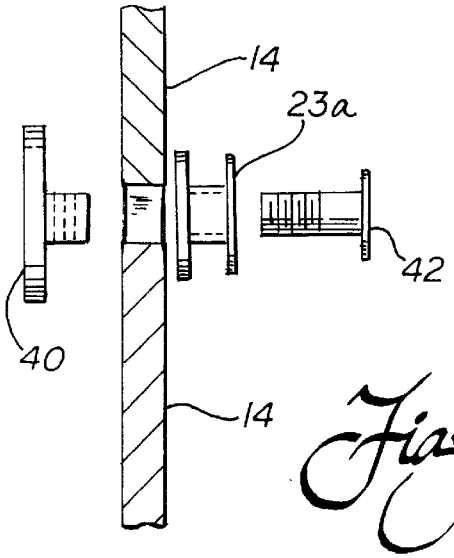
Fig. 6
Fig. 7
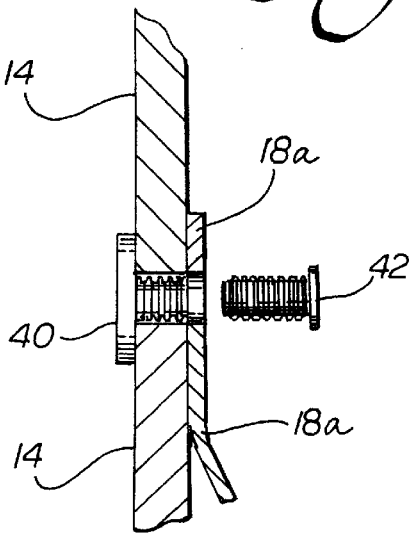

CHIN STRAP SYSTEM

FIELD OF THE INVENTION

The present invention relates to chin straps. More particularly, the invention relates to chin straps for use with helmets.

BACKGROUND AND SUMMARY OF THE INVENTION

Attempts have been made to provide chin strap systems of the type used for helmets, particularly football helmets, which are comfortable and adjustable. However, conventional chin straps desire improvement. There is also a need for a chin strap system that is better suited for high hook-up usage but which is versatile in that it is also suitable for low hook-up usage.

Accordingly it is an object of the present invention to provide an improved chin strap system.

Still another object of the present invention is to provide a chin strap system of the character described that is comfortable, adjustable and versatile.

A still further object of the invention is to provide a chin strap system of the character described that is economical to produce and uncomplicated in configuration.

With regard to the foregoing and other objects, the present invention is directed to a chin strap system.

In a preferred embodiment, the chin strap system includes a pair of elongate straps and a substantially rigid cup configured for receiving a chin of a user. The cup includes an outer surface opposite an inner surface, the inner surface defining a central valley portion for receiving a mental protuberance region of the chin of a user, a ridge portion adjacent the central valley portion for receiving a mentum portion of the chin of a user, and a lower sloped portion adjacent the central valley portion opposite the ridge portion for receiving the sub mentum portion of the chin of a user. Four apertures extend between the inner and outer surface of the cup for receiving the straps, with two of the apertures being located adjacent an end of the central valley portion and the other two of the apertures being located adjacent an opposite end of the central valley portion.

The straps are adjustably positionable through the apertures so that the straps crisscross one another adjacent the outer surface of the cup between the apertures and each strap has a pair of free ends extending in opposite directions from the cup. Fasteners are operatively associated with free ends of the straps for fastening the straps to a helmet with which the strap is to be used.

BRIEF DESCRIPTION OF THE DRAWINGS

Further advantages of the invention will become apparent by reference to the detailed description of preferred embodiments when considered in conjunction with the figures, which are not to scale, wherein like reference numbers, indicate like elements through the several views, and wherein.

FIG. 4 is a front view of a cup portion of the chin strap of FIG. 2.

FIG. 6 shows attachment of a snap stud to the helmet shell.

FIG. 7 shows attachment of strap portions to the shell.

DETAILED DESCRIPTION

Figure 1:
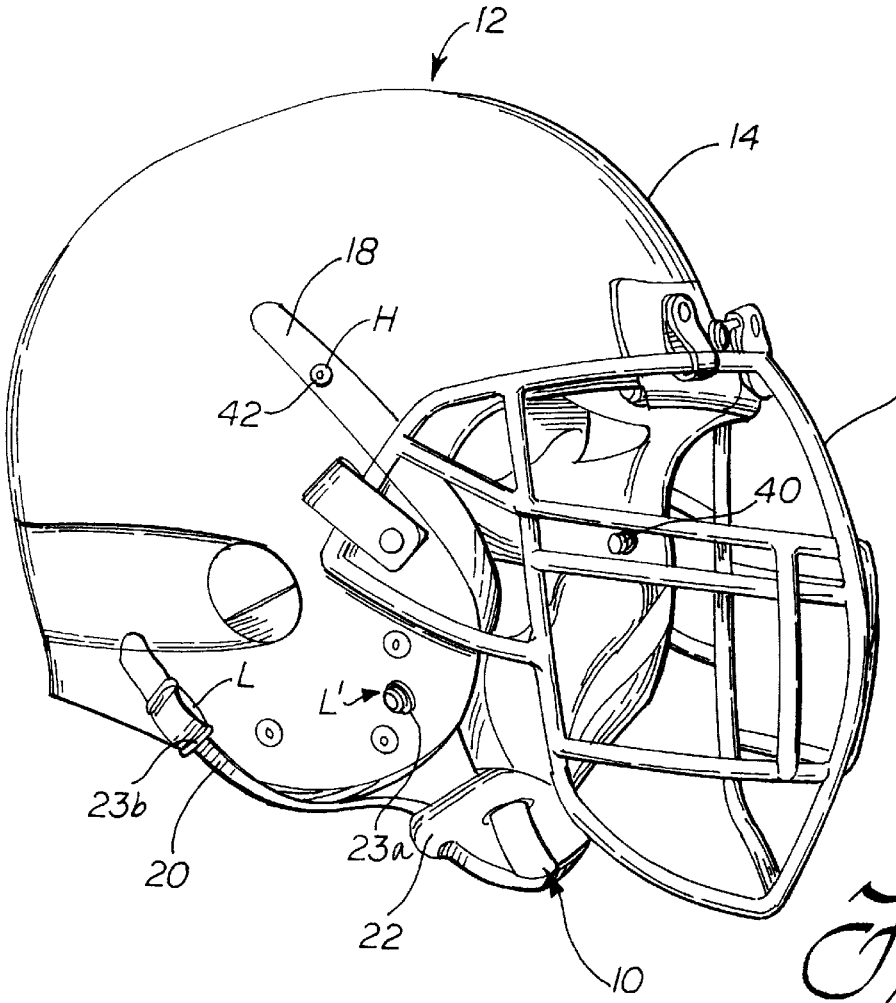
FIG. 1 is a right-side perspective view of a football helmet equipped with a chin strap system in accordance with a preferred embodiment of the invention.

With reference to FIGS. 1–5, the invention relates to a chin strap system 10 that is particularly suitable for use with football helmets, such as helmet 12 having a shell 14 and face mask 16 attached to the shell 14. The chin strap system 10 includes straps 18 and 20 and cup 22.

The strap system 10 is shown in FIG. 1 in a so-called "high hook-up" configuration using a pair of low attachment points L on opposite sides of the shell 14 and a pair of high attachment points H on opposite sides of the shell 14. However, the strap system may be used in a so-called low hook-up configuration, using the low attachment points L and additional low attachment points L' located on opposite sides of the shell 14. Each of the low attachment points L and L' is preferably provided by snap studs 23*a* secured to the shell 14 and which releasably receive snap buckles 23*b* adjustably receivable on strap portions 18*b* and 20*b*.

Each of the straps 18 and 20 are preferably unitary lengths of strap material, each preferably of substantially the same length, which length preferably ranges from about 15 to about 23 inches, depending upon the helmet size and the hook-up configuration. The straps 18 and 20 are preferably webbing reinforced plastic strips, having a substantially uniform width of from about ⅜ to about ⅝ inches. A seen in FIGS. 2 and 3, the straps 18 and 20 are slidably passed through apertures in the cup 22, with the straps crisscrossing one another adjacent an exterior portion of the cup 22, designated on FIG. 2 as X. Thus, portions 18*a* and 18*b* of the strap 18 and portions 20*a* and 20*b* of the strap 20 extend from the cup 22 and have free ends.

Figure 5:
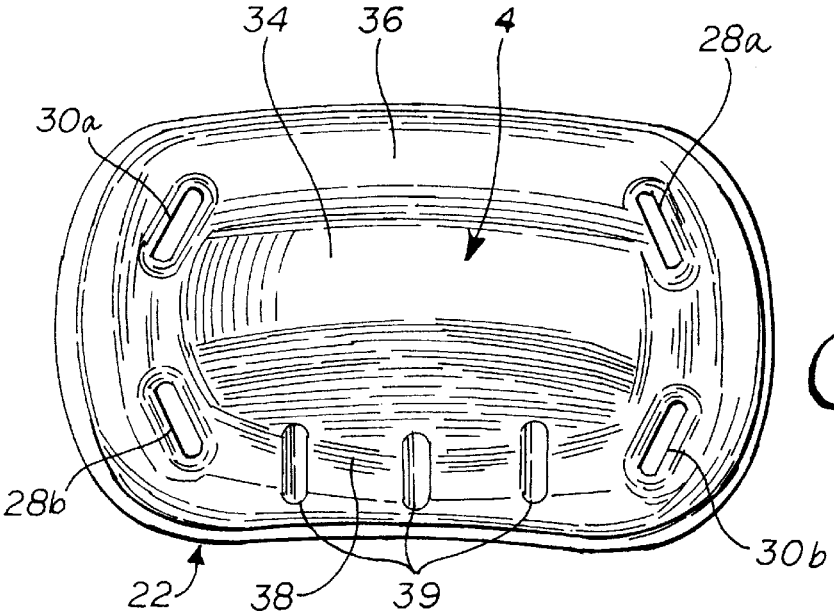
FIG. 5 is a rear view of the cup portion of FIG. 4
Figure 2:
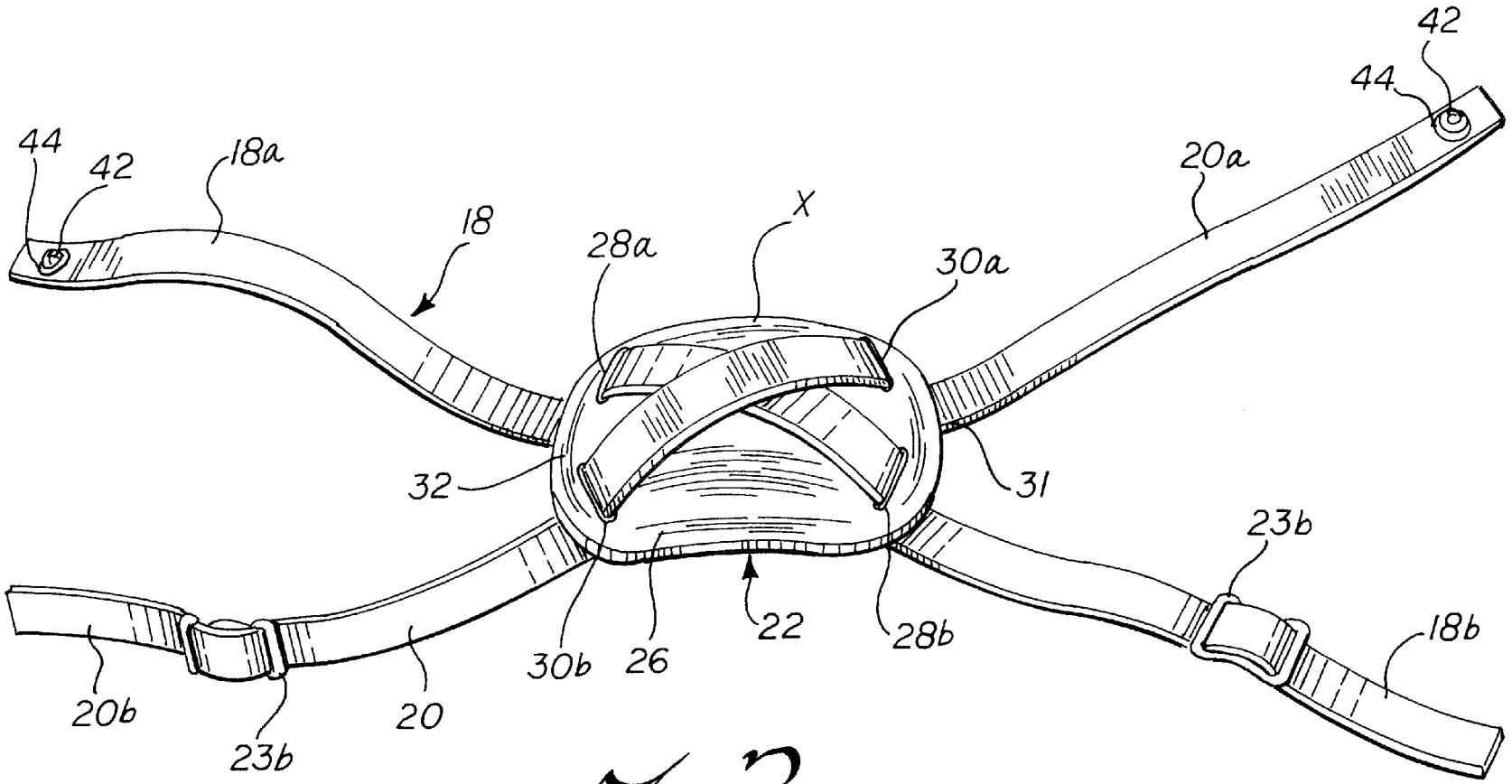
FIG. 2 is a front view of the chin strap which is shown attached to a helmet in FIG. 1.

With reference to FIGS. 4 and 5, the cup 22 is preferably of molded construction and substantially rigid. The cup 22 is substantially curved so that it includes an inner curved surface 24 configured to receive the chin of a user and an opposite outer curved surface 26. The curved surface 24 is preferably made of a soft foam material. The curved surface 26 is preferably of a substantially rigid plastic material for maintaining the shape of the cup 22. Apertures in the form of slits 28*a* and 28*b* are provided through the cup 22 for receiving strap 18 and apertures in the form of slits 30*a* and 30*b* are provided through the cup 22 for receiving the strap 20. As will be appreciated, the straps are adjustable relative to the cup.

The surface 26 of the cup includes a pair of raised portions 31 and 32 which are preferably substantially V-shaped and located between slit pairs 28*a* and 30*b* and 30*a* and 28*b*, respectively, for contacting edges of the straps 18 and 20 to aid in maintaining them straps in the crisscrossed orientation.

Figures 3, 5A:
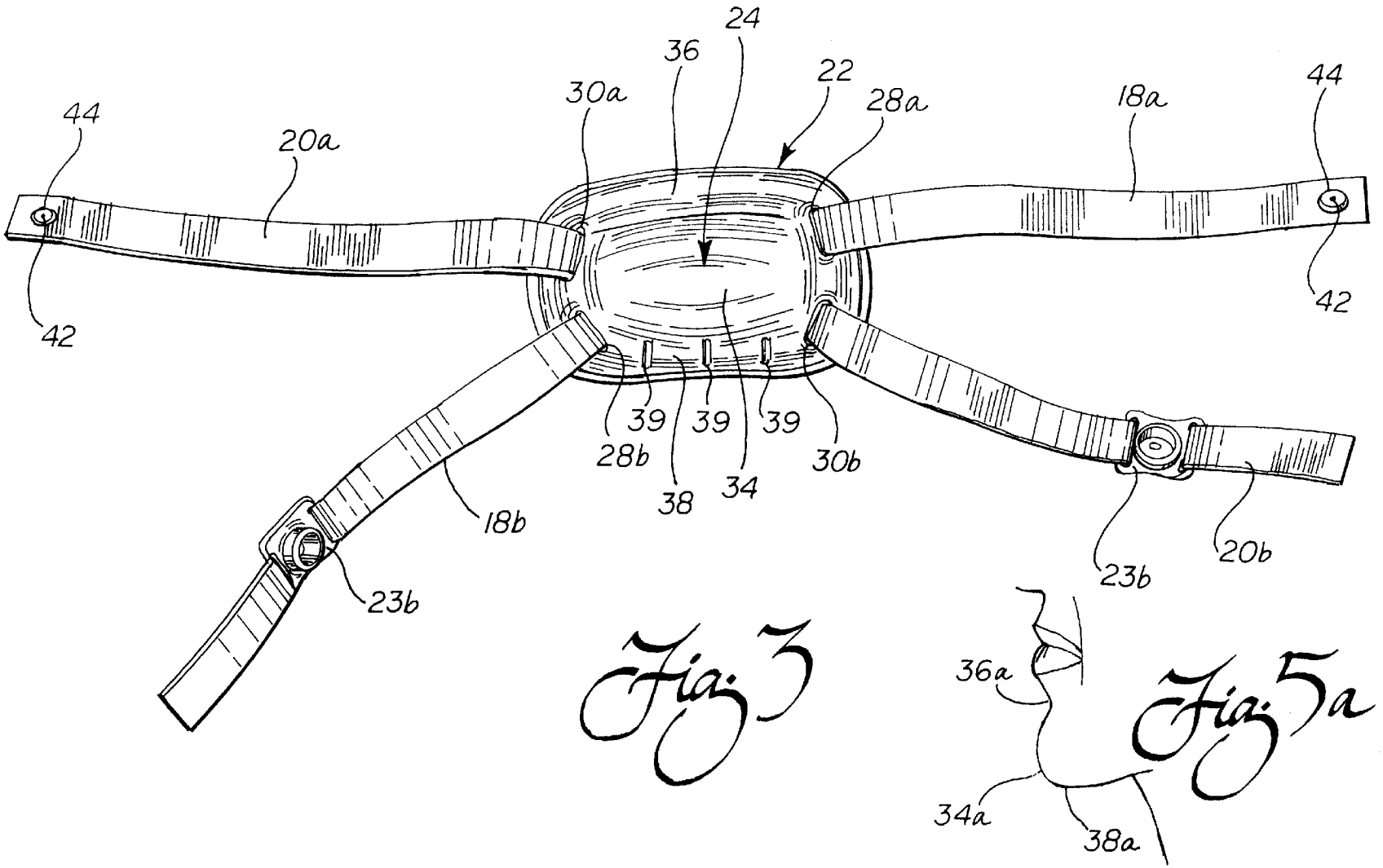
FIG. 3 is a rear view of the chin strap of FIG. 2.
FIG. 5*a* is a side view showing portions of a chin of a user receivable by the cup portion.

With further reference to FIG. 5 and with reference to FIG. 5*a*, the surface 24 is anatomically configured for receiving the chin of a user and includes a central valley portion 34 for receiving the pognion or mental protuberance 34*a* of the chin, an upper ridge portion 36 for abutting the mentum 36*a* above the protuberance 34*a*, and a lower sloped portion 38 for abutting the sub mentum 38*a* of the chin of a user. The portion 38 preferably includes a plurality of indented ribs 39.

With reference to FIG. 6, the snap studs 23*a* are secured to the shell 14 in a conventional manner, using a flange/ threaded cylinder 40 passes through an aperture in the shell 14 and receives a screw 42. If the low attachment points L' are used instead of the high attachment points H, snap buckles 23*b* should be provided on the straps 18*a* and 20*a*. Attachment points H may also be provided by the snap studs secured to the shell 14, with snap buckles 23*b* provided on the straps 20*a* and 20*b*. However, with reference to FIG. 7, it is preferred that the attachment points H be provided by flange/threaded cylinder 40 and screw 42, with the screw 42 passing through an alignable aperture 44 in the strap portions 18*a* and 20*a*.

The foregoing description of certain exemplary embodiments of the present invention has been provided for purposes of illustration only, and it is understood that numerous modifications or alterations may be made in and to the illustrated embodiments without departing from the spirit and scope of the invention as defined in the following claims.

What is claimed is:

1. A chin strap system for a helmet, comprising:

a pair of elongate straps;

a substantially rigid cup configured for receiving a chin of a user, the cup comprising an outer surface opposite an inner surface, the inner surface defining a central valley portion for receiving a mental protuberance region of the chin of a user, a ridge portion adjacent the central valley portion for receiving a mentum portion of the chin of a user, and a lower sloped portion adjacent the central valley portion opposite the ridge portion for receiving the sub mentum portion of the chin of a user, four apertures extending between the inner and outer surface of the cup for receiving the straps, with two of the apertures being located adjacent an end of the central valley portion and the other two of the apertures being located adjacent an opposite end of the central valley portion, wherein the straps are adjustably positionable through the apertures so that the straps crisscross one another adjacent the outer surface of the cup between the apertures and each strap has a pair of free ends extending in opposite directions from the cup; and fasteners operatively associated with free ends of the straps for fastening the straps to a helmet with which the strap is to be used.

2. The chin strap system of claim 1, wherein the outer surface of the cup includes a pair of raised V-shaped portions adjacent the apertures for contacting edges of the straps to aid in maintaining them in a crisscrossed orientation.

3. The chin strap system of claim 1, wherein the outer surface is made of a substantially rigid plastic material.

4. The chin strap system of claim 1, wherein the inner surface is made of a substantially soft foam material.

* * * * *